US008469117B2

(12) United States Patent
Pafitis et al.

(10) Patent No.: US 8,469,117 B2
(45) Date of Patent: Jun. 25, 2013

(54) DRILL BITS AND METHODS OF DRILLING CURVED BOREHOLES

(75) Inventors: Demosthenis Georgiou Pafitis, Cambridge (GB); Jahir Pabon, Newton, MA (US); Joachim Sihler, Gloucestershire (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/564,705

(22) Filed: Aug. 1, 2012

(65) Prior Publication Data

US 2012/0292115 A1 Nov. 22, 2012

(51) Int. Cl.
*E21B 7/08* (2006.01)
*E21B 10/62* (2006.01)

(52) U.S. Cl.
USPC ..... 175/61; 175/382

(58) Field of Classification Search
USPC ..... 175/61, 73, 382, 383
See application file for complete search history.

(56) References Cited

U.S. PATENT DOCUMENTS

| | | | | |
|---|---|---|---|---|
| 2,241,712 | A | 2/1938 | McNamara | |
| 2,241,746 | A * | 5/1941 | Noble et al. | 175/61 |
| 4,467,879 | A * | 8/1984 | Burge | 175/325.4 |
| 5,113,953 | A | 5/1992 | Noble | |
| 5,265,682 | A | 11/1993 | Russell et al. | |
| 5,484,029 | A | 1/1996 | Eddison | |
| 5,520,255 | A | 5/1996 | Barr et al. | |
| 5,553,678 | A | 9/1996 | Barr et al. | |
| 5,553,679 | A | 9/1996 | Thorp | |
| 5,582,259 | A | 12/1996 | Barr | |
| 5,603,385 | A | 2/1997 | Colebrook | |
| 5,673,763 | A | 10/1997 | Thorp | |
| 5,685,379 | A | 11/1997 | Barr et al. | |
| 5,695,015 | A | 12/1997 | Barr et al. | |
| 5,706,905 | A | 1/1998 | Barr | |
| 5,778,992 | A | 7/1998 | Fuller | |
| 5,803,185 | A | 9/1998 | Barr et al. | |
| 5,971,085 | A | 10/1999 | Colebrook | |
| 6,089,332 | A | 7/2000 | Barr et al. | |
| 6,092,610 | A | 7/2000 | Kosmala et al. | |
| 6,131,675 | A | 10/2000 | Anderson | |
| 6,142,250 | A | 11/2000 | Griffin et al. | |
| 6,158,529 | A | 12/2000 | Dorel | |
| 6,244,361 | B1 | 6/2001 | Comeau et al. | |
| 6,364,034 | B1 | 4/2002 | Schoeffler | |
| 6,394,193 | B1 | 5/2002 | Askew | |
| 7,207,398 | B2 * | 4/2007 | Runia et al. | 175/61 |
| 2001/0052428 | A1 | 12/2001 | Larronde et al. | |
| 2002/0011359 | A1 | 1/2002 | Webb et al. | |
| 2004/0238221 | A1 * | 12/2004 | Runia et al. | 175/61 |
| 2006/0131030 | A1 | 6/2006 | Sheffield | |
| 2007/0154341 | A1 | 7/2007 | Saenger | |
| 2008/0000693 | A1 | 1/2008 | Hutton | |
| 2009/0044979 | A1 | 2/2009 | Johnson et al. | |

* cited by examiner

*Primary Examiner* — Kenneth L Thompson
*Assistant Examiner* — Catherine Loikith
(74) *Attorney, Agent, or Firm* — Chadwick A. Sullivan

(57) ABSTRACT

The invention provides drill bits and methods of drilling curved boreholes. One aspect of the invention provides a drill bit including a bit body and one or more blades positioned within the bit body, the one or more blades individually actuatable to a plurality of cut depths. Another aspect of the invention provides a method for drilling a curved borehole. The method includes: providing a drill string including a drill bit including a bit body and one or more blades positioned within the bit body, the one or more blades individually actuatable to a plurality of cut depths; rotating the drill string; and selectively actuating the one or more blades to a plurality of cut depths; thereby drilling a curved borehole.

8 Claims, 8 Drawing Sheets

DRILL BITS AND METHODS OF DRILLING CURVED BOREHOLES

BACKGROUND

Controlled steering or directional drilling techniques are commonly used in the oil, water, and gas industry to reach resources that are not located directly below a wellhead. The advantages of directional drilling are well known and include the ability to reach reservoirs where vertical access is difficult or not possible (e.g. where an oilfield is located under a city, a body of water, or a difficult to drill formation) and the ability to group multiple wellheads on a single platform (e.g. for offshore drilling).

With the need for oil, water, and natural gas increasing, improved and more efficient apparatus and methodology for extracting natural resources from the earth are necessary.

SUMMARY OF THE INVENTION

The invention provides drill bits and methods of drilling curved boreholes.

One aspect of the invention provides a drill bit including a bit body and one or more blades positioned within the bit body, the one or more blades individually actuatable to a plurality of cut depths.

This aspect can have a variety of embodiments. In the embodiment, the drill bit includes one or more actuators coupled with the one or more blades for actuating the one or more blades to the plurality of cut depths. In some embodiments, the one or more actuators can be pistons. In other embodiments, the one or more actuators can be piezoelectric actuators.

In another embodiment, the drill bit includes a controller in communication with the one or more actuators. The controller can be configured to actuate the one or more blades such that the cut depth of the one or more blades varies with respect to a rotational position of the drill bit. In one embodiment, the one or more blades are each mounted on a pivot point.

The plurality of cut depths can vary with respect to a leading face of the drill bit. The plurality of cut depths can vary with respect to a lateral face of the drill bit.

In some embodiments, the actuation of the one or more blades creates a side force. In other embodiments, the actuation of the one or more blades creates a curved hole geometry.

Another aspect of the invention provides a method for drilling a curved borehole. The method includes: providing a drill string including a drill bit including a bit body and one or more blades positioned within the bit body, the one or more blades individually actuatable to a plurality of cut depths; rotating the drill string; and selectively actuating the one or more blades to a plurality of cut depths; thereby drilling a curved borehole.

Another aspect of the invention provides a drill including: a first bit body having an axis of rotation and a plurality of exterior cutters; a second bit body having an axis of rotation and a plurality of exterior cutters; a flexible joint connecting the first bit body and the second bit body; and one or more actuators configured to modulate an angle between the axis of rotation of the first bit body and the axis of rotation of the second bit body.

This aspect can have a variety of embodiments. In one embodiment, the drill bit includes a flexible sleeve positioned between the first bit body and the second bit body.

The one or more actuators can be compression or tension actuators.

The drill bit can include a controller in communication with the one or more actuators. The one or more actuators can be each actuated at a frequency substantially equal to the rotational frequency of the drill bit. The one or more actuators can include sensors.

Another aspect of the invention provides a method for drilling a curved borehole. The method includes: providing a drill string including a drill bit including a first bit body having an axis of rotation and a plurality of exterior cutters; a second bit body having an axis of rotation and a plurality of exterior cutters; a flexible joint connecting the first bit body and the second bit body; and one or more actuators configured to modulate an angle between the axis of rotation of the first bit body and the axis of rotation of the second bit body; rotating the drill string; and selectively actuating the one or more actuators to modulate the angle between the axis of rotation of the first bit body and the axis of rotation of the second bit body; thereby drilling a curved borehole.

DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views and wherein.

DETAILED DESCRIPTION OF THE INVENTION

The invention provides drill bits and methods of drilling curved boreholes. Some embodiments of the invention can be used in a wellsite system.

Wellsite System

Figure 1:
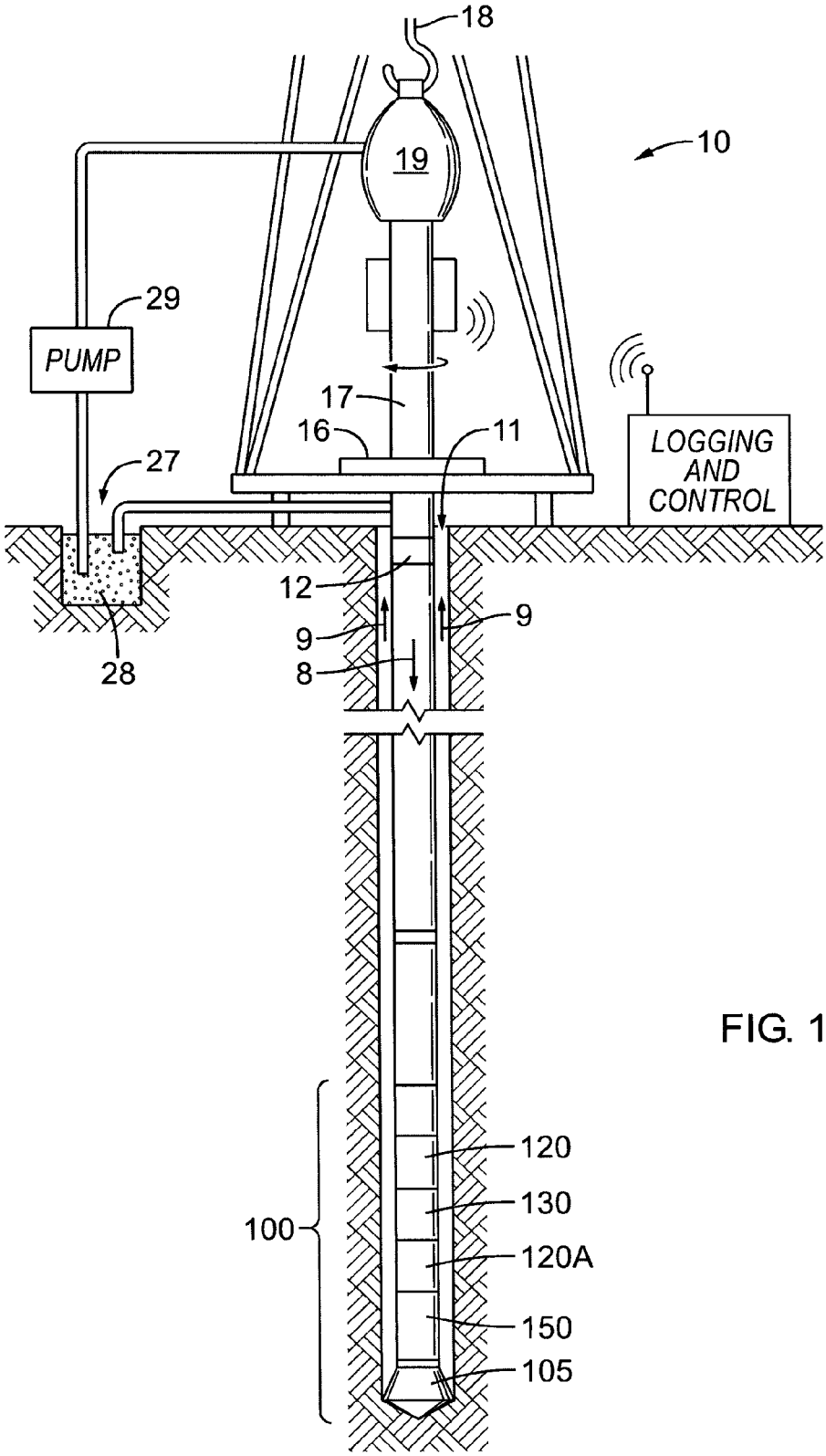
FIG. 1 illustrates a wellsite system in which the present invention can be employed.

FIG. 1 illustrates a wellsite system in which the present invention can be employed. The wellsite can be onshore or offshore. In this exemplary system, a borehole 11 is formed in subsurface formations by rotary drilling in a manner that is well known. Embodiments of the invention can also use directional drilling, as will be described hereinafter.

A drill string 12 is suspended within the borehole 11 and has a bottom hole assembly (BHA) 100 which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook. As is well known, a top drive system could alternatively be used.

In the example of this embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string and the wall of the borehole, as indicated by the directional arrows 9. In this well known manner, the drilling fluid lubricates the drill bit 105 and carries formation cuttings up to the surface as it is returned to the pit 27 for recirculation.

The bottom hole assembly 100 of the illustrated embodiment includes a logging-while-drilling (LWD) module 120, a measuring-while-drilling (MWD) module 130, a roto-steerable system and motor, and drill bit 105.

The LWD module 120 is housed in a special type of drill collar, as is known in the art, and can contain one or a plurality of known types of logging tools. It will also be understood that more than one LWD and/or MWD module can be employed, e.g. as represented at 120A. (References, throughout, to a module at the position of 120 can alternatively mean a module at the position of 120A as well.) The LWD module includes capabilities for measuring, processing, and storing information, as well as for communicating with the surface equipment. In the present embodiment, the LWD module includes a pressure measuring device.

The MWD module 130 is also housed in a special type of drill collar, as is known in the art, and can contain one or more devices for measuring characteristics of the drill string and drill bit. The MWD tool further includes an apparatus (not shown) for generating electrical power to the downhole system. This may typically include a mud turbine generator (also known as a "mud motor") powered by the flow of the drilling fluid, it being understood that other power and/or battery systems may be employed. In the present embodiment, the MWD module includes one or more of the following types of measuring devices: a weight-on-bit measuring device, a torque measuring device, a vibration measuring device, a shock measuring device, a stick slip measuring device, a direction measuring device, and an inclination measuring device.

A particularly advantageous use of the system hereof is in conjunction with controlled steering or "directional drilling." In this embodiment, a roto-steerable subsystem 150 (FIG. 1) is provided. Directional drilling is the intentional deviation of the wellbore from the path it would naturally take. In other words, directional drilling is the steering of the drill string so that it travels in a desired direction.

Directional drilling is, for example, advantageous in offshore drilling because it enables many wells to be drilled from a single platform. Directional drilling also enables horizontal drilling through a reservoir. Horizontal drilling enables a longer length of the wellbore to traverse the reservoir, which increases the production rate from the well.

A directional drilling system may also be used in vertical drilling operation as well. Often the drill bit will veer off of a planned drilling trajectory because of the unpredictable nature of the formations being penetrated or the varying forces that the drill bit experiences. When such a deviation occurs, a directional drilling system may be used to put the drill bit back on course.

A known method of directional drilling includes the use of a rotary steerable system ("RSS"). In an RSS, the drill string is rotated from the surface, and downhole devices cause the drill bit to drill in the desired direction. Rotating the drill string greatly reduces the occurrences of the drill string getting hung up or stuck during drilling. Rotary steerable drilling systems for drilling deviated boreholes into the earth may be generally classified as either "point-the-bit" systems or "push-the-bit" systems.

In the point-the-bit system, the axis of rotation of the drill bit is deviated from the local axis of the bottom hole assembly in the general direction of the new hole. The hole is propagated in accordance with the customary three-point geometry defined by upper and lower stabilizer touch points and the drill bit. The angle of deviation of the drill bit axis coupled with a finite distance between the drill bit and lower stabilizer results in the non-collinear condition required for a curve to be generated. There are many ways in which this may be achieved including a fixed bend at a point in the bottom hole assembly close to the lower stabilizer or a flexure of the drill bit drive shaft distributed between the upper and lower stabilizer. In its idealized form, the drill bit is not required to cut sideways because the bit axis is continually rotated in the direction of the curved hole. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953.

In the push-the-bit rotary steerable system there is usually no specially identified mechanism to deviate the bit axis from the local bottom hole assembly axis; instead, the requisite non-collinear condition is achieved by causing either or both of the upper or lower stabilizers to apply an eccentric force or displacement in a direction that is preferentially orientated with respect to the direction of hole propagation. Again, there are many ways in which this may be achieved, including non-rotating (with respect to the hole) eccentric stabilizers (displacement based approaches) and eccentric actuators that apply force to the drill bit in the desired steering direction. Again, steering is achieved by creating non co-linearity between the drill bit and at least two other touch points. In its idealized form, the drill bit is required to cut side ways in order to generate a curved hole. Examples of push-the-bit type rotary steerable systems and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; and 5,971,085.

Individually Actuatable Blades

Figure 2A:
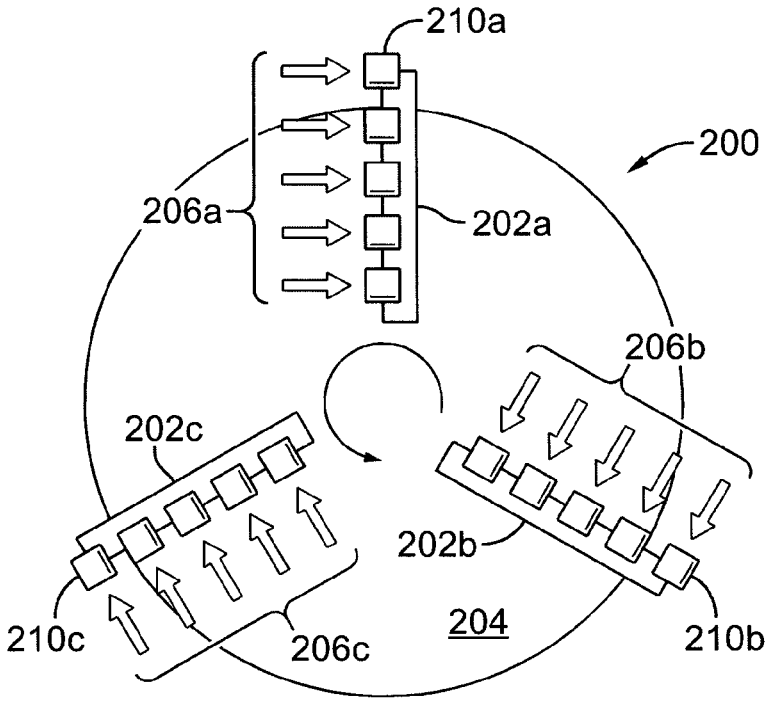
FIGS. 2A-2D depict a drill bit having one or more individually actuatable blades positioned within a bit body according to one embodiment of the invention.
Figure 2B:
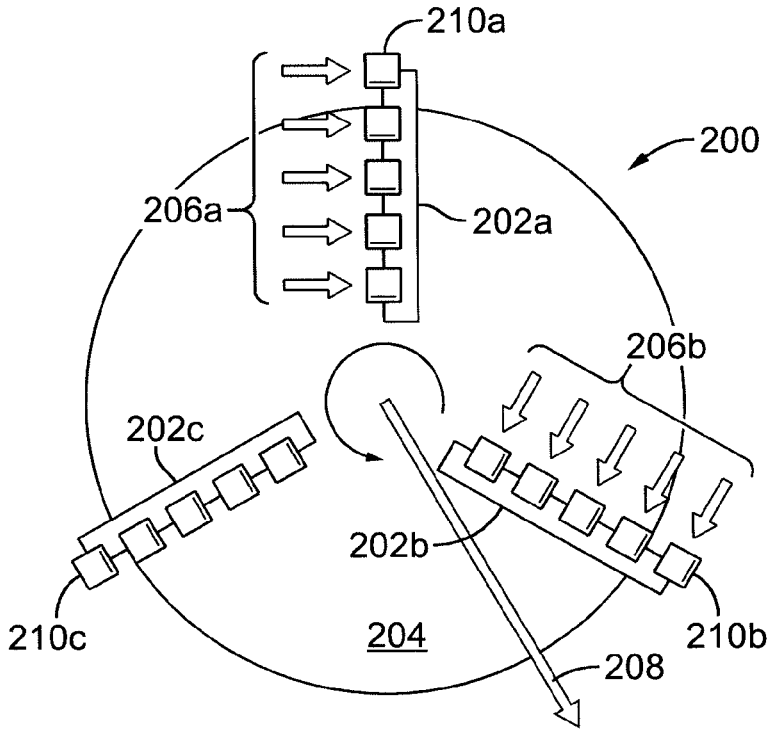

Referring to FIGS. 2A and 2B, some embodiments of the invention include drill bits 200 having one or more individually actuatable blades 202*a*-202*c* positioned within a bit body 204.

When each blade 202*a*-202*c* is positioned to a substantially similar position (e.g., depth and/or width with regard to the profile of the bit body 204), the sideways forces 206*a*-206*c* generated as the drill bit 200 rotates within a borehole substantially counteract each other, resulting in a net sideways force with minimal magnitude.

However, when blade 202*c* is retracted as depicted in FIG. 2B, the sideways forces 206*a*, 206*b* do not net to zero and the resultant sideways force 208 can be harnessed to push the drill bit 200 in a desired direction.

In some embodiments, one or more cutters 210*a*-210*c* are mounted on blades 202*a*-202*c* to enhance drilling. The cutters 210*a*-210*c* are preferably a hard material such as polycrystalline diamond compact (PDC), ceramics, carbides, cermets, and the like.

Figure 2D:
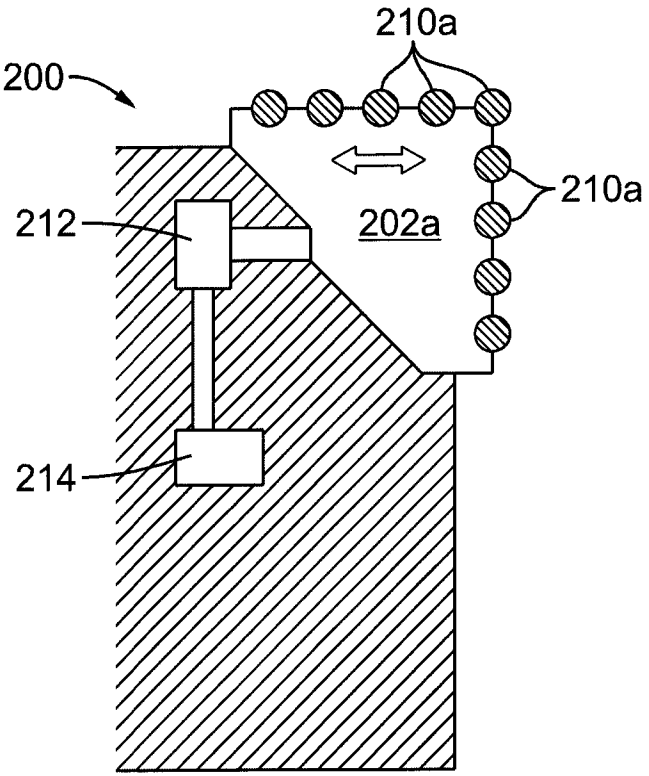
Figure 2C:
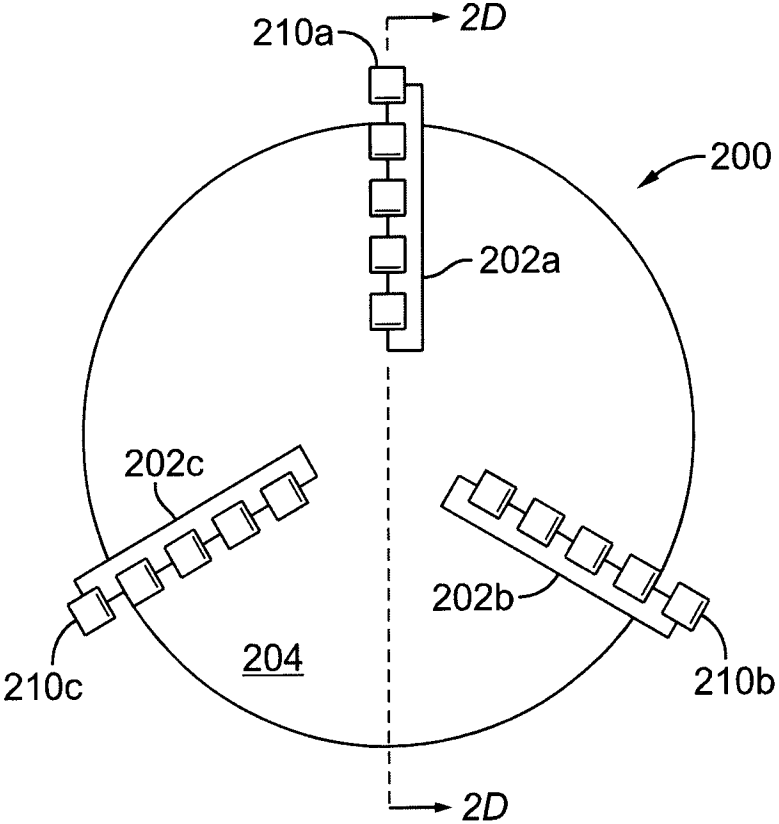

Referring now to FIGS. 2C and 2D, drill bit 200 can include one or more actuators 212 coupled with blades 202*a*-202*c* in order to actuate the blades to a plurality of cut depths. As will be appreciated by one of ordinary skill in the art, a variety of actuators can be used including pistons, vacuums, motors, piezoelectric elements, servos, magnets, and the like. Actuators 212 can be controlled by a controller 214 in communication with actuators 212. A variety of controllers 214 can be selected to reflect the variety of suitable actuators. For example, if actuators 212 are hydraulic or pneumatic pistons, controller 214 can be a valve. In another example, if actuators 212 are electrical actuators, controller can be an electronic device. In still another example, if actuators are mechanical actuators, controller 214 can transmit force to actuators 212 via one or more mechanical linkages.

Controller 214 can be configured to cyclically alter the position of one or more blades 202*a*-202*c* as drill bit 200 rotates to drill a curved hole. For example, controller 214 can retract each particular blade 202*a*-202*c* when the blade is about 90° prior to the target steering direction. In some embodiments, the actuation of blades 202*a*-202*c* may be sinusoidal with a frequency substantially equal to the rotational frequency of drill bit 200.

In embodiments in which the blades 202*a*-202*c* are selected actuated, the controller 214 can maintain the proper angular position of the bottom hole assembly relative to the subsurface formation. In some embodiments, the controller 214 is mounted on a bearing that allows the controller 214 to rotate freely about the axis of the bottom hole assembly. The controller 214, according to some embodiments, contains sensory equipment such as a three-axis accelerometer and/or magnetometer sensors to detect the inclination and azimuth of the bottom hole assembly. The controller 214 can further communicate with sensors disposed within elements of the bottom hole assembly such that said sensors can provide formation characteristics or drilling dynamics data to control unit. Formation characteristics can include information about adjacent geologic formation gather from ultrasound or nuclear imaging devices such as those discussed in U.S. Patent Publication No. 2007/0154341, the contents of which is hereby incorporated by reference herein. Drilling dynamics data may include measurements of the vibration, acceleration, velocity, and temperature of the bottom hole assembly.

In some embodiments, controller 214 is programmed above ground to following a an desired inclination and direction. The progress of the bottom hole assembly can be measured using MWD systems and transmitted above-ground via a sequences of pulses in the drilling fluid, via an acoustic or wireless transmission method, or via a wired connection. If the desired path is changed, new instructions can be transmitted as required. Mud communication systems are described in U.S. Patent Publication No. 2006/0131030, herein incorporated by reference. Suitable systems are available under the POWERPULSE™ trademark from Schlumberger Technology Corporation of Sugar Land, Tex.

Figure 3A:
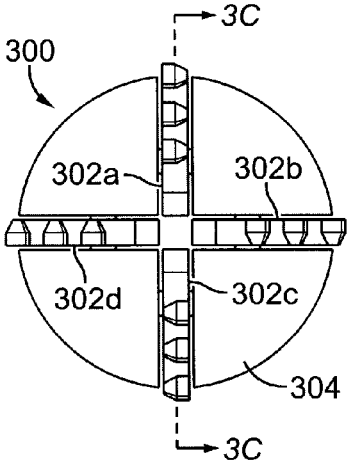
FIGS. 3A-3D depict a drill bit including blades mounted on pivot points within a bit body according to one embodiment of the invention.
Figure 3C:
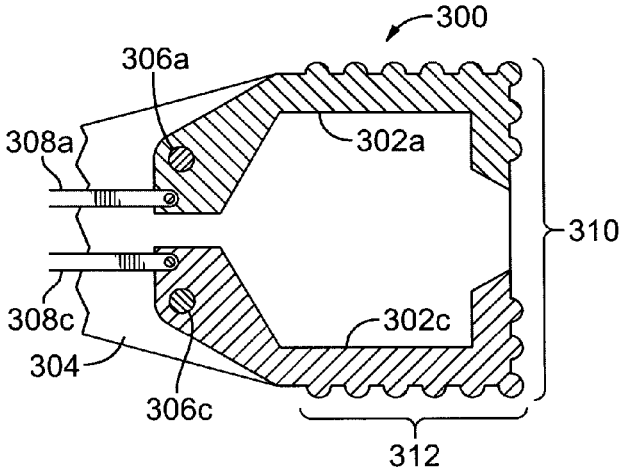
Figure 3B:
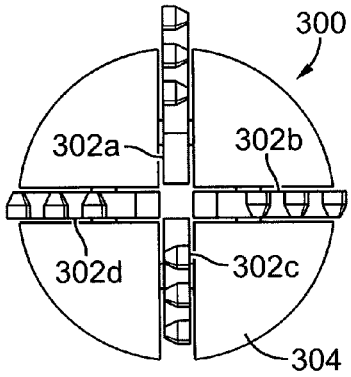
Figure 3D:
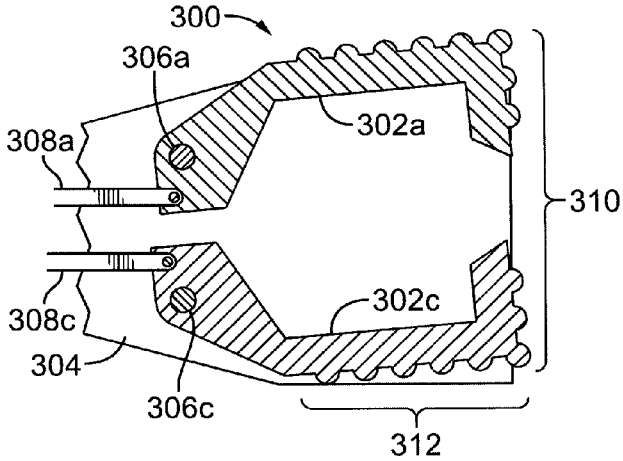

Referring now to FIGS. 3A-3D, another embodiment of the invention provides drill bits 300 includes blades 302*a*-302*d* mounted on pivots points, e.g. pivot points 306*a* and 306*c*, within bit body 304. One or more actuators (e.g., push rods 308*a* and 308*c*) can cause one or more blades 302*a*-302*d* to rotate about the corresponding pivot point and extend further beyond or retract within the profile of bit body 304 as depicted in FIG. 3B and FIG. 3D in order to steer the drill bit 300. Pivot points, e.g. pivot points 306*a* and 306*c*, can be a pin, bolt, screw, rivet, nail, bushing, and the like.

Figure 4:
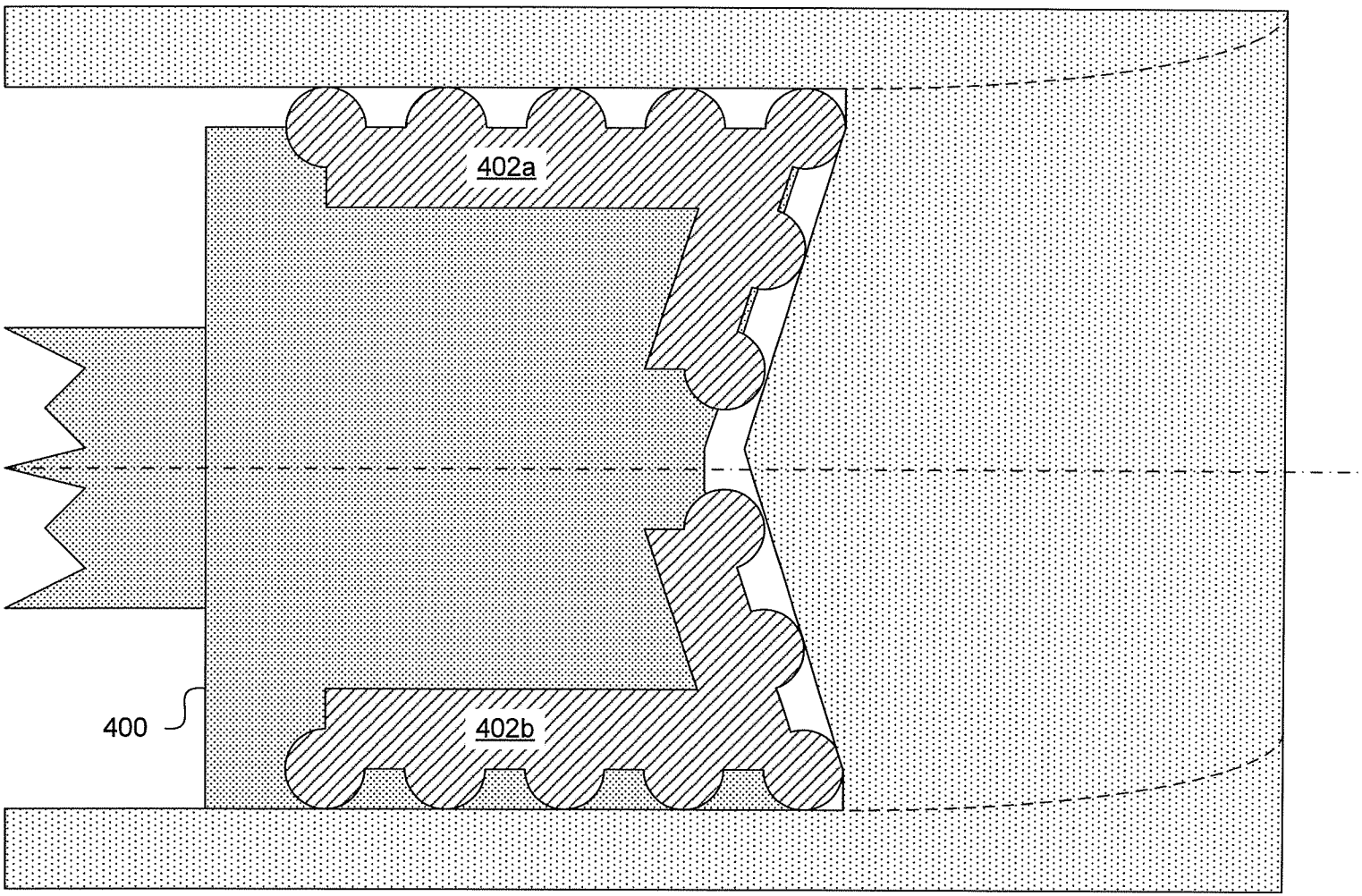
FIG. 4 depicts the selective control of the lateral cutting depth of a drill bit to steer the bit by cutting more aggressively on the inside of the curve according to one embodiment of the invention.

As depicted in FIGS. 3A-3B, blades can be displaced with respect to a leading face 310 and/or a lateral face of the drill bit 200, 300. Referring to FIG. 4, the lateral cutting depth of a blades 402 within a drill bit 400 can be controlled to steer the bit by cutting more aggressively on the inside of the curve. Thus, to drill an upwardly curved borehole as depicted by the curved dashed lines, blade 402*a* is extended laterally from drill bit 400 to cut more aggressively on the inside of the curve while blade 402*b* is retracted within drill bit 400 to cut less aggressively on the outside of the curve.

Method of Drilling a Curved Borehole

Figure 5:
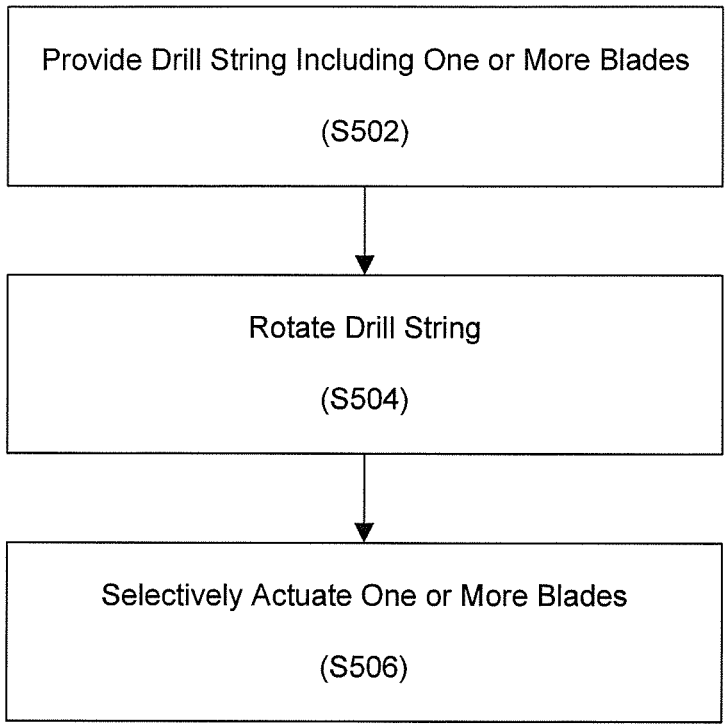
FIG. 5 depicts a method of drilling a curved borehole according to one embodiment of the invention.

Referring now to FIG. 5, a method of drilling a curved borehole is depicted. In step S502, a drill string is provided including a drill bit having a bit body and one or more blades positioned within the bit body. Suitable drill bits are described herein. The one or more blades are individually actuatable to a plurality cut depths. In step S504, the drill string is rotated. In step S506, one or more of the blades is selectively actuated to a plurality of cut depths.

Multi-Bit-Body Drill Bit

Figure 6B:
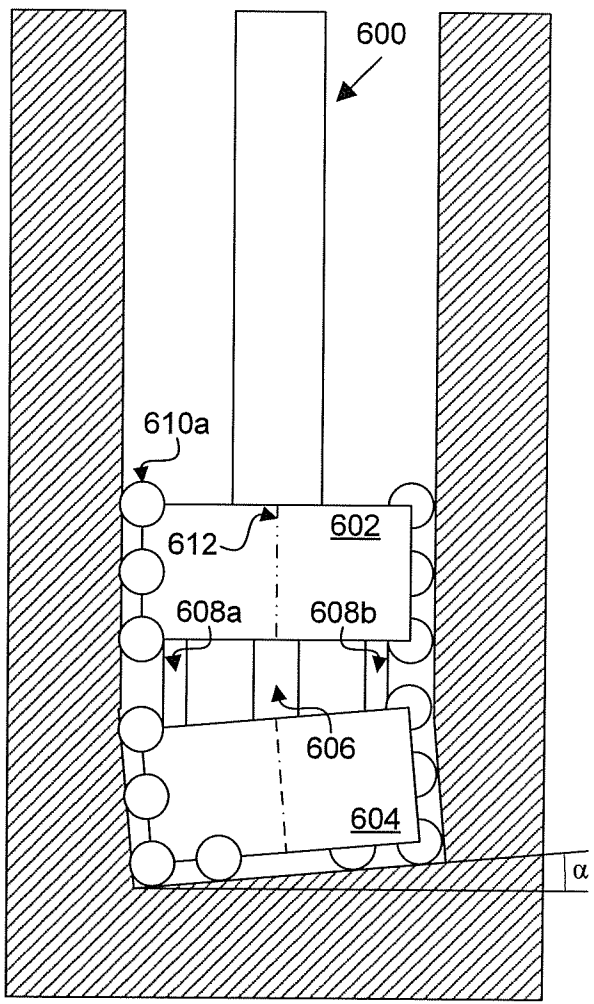
FIGS. 6A & 6B depict a drill bit including a first bit body, a second bit body, a flexible joint, and one or more actuators according to one embodiment of the invention.
Figure 6A:
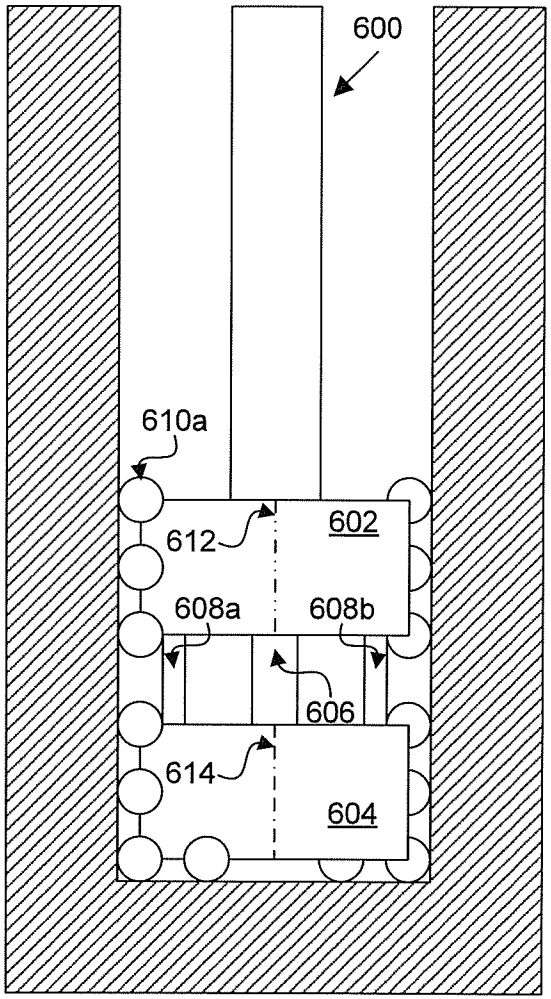

Referring now to FIGS. 6A & 6B, a drill bit is provided including a first bit body 602, a second bit body 604, a flexible joint 606 connecting the first bit body 602 and the second bit body 604, and one or more actuators, e.g. actuators 608*a* or 608*b*, configured to modulate an angle between the axis of rotation of the first bit body and the axis of rotation of the second bit body. Each bit body 602, 604 has a plurality of exterior cutters 610*a* and an axis of rotation 612, 614.

Flexible joint 606 can be any joint capable of transmitting torque and weight on bit from the first bit body 602 to the second bit body 604 while still allowing modulation of the angle between the axis of rotation of the first bit body and the axis of rotation of the second bit body. A variety of flexible joints are available including universal joints (also known as a U joints, Cardan joints, and Hardy-Spicer joints), constant-velocity joints (also known as CV joints and homokinetic joints), Rzeppa joints, double Cardan joints, Thompson constant velocity joints (also known as TCVJs and Thompson couplings), and the like.

Actuators, e.g. actuators 608*a* or 608*b*, can be compression actuators that push regions of the bit bodies 602, 604 apart and/or tension actuators that pull regions of the bit bodies 602, 604 together. A variety of actuators can be used including pistons, vacuums, motors, piezoelectric elements, servos, magnets, and the like. Actuators 608 can be controlled by a controller (not depicted) as discussed herein.

Controller can be configured to cyclically alter angle between bit bodies 602, 604 as drill bit 600 rotates to drill a curved hole. In some embodiments, actuators are actuated sinusoidally with a frequency substantially equal to the rotational frequency of drill bit 600.

In some embodiments, a flexible sleeve is positioned between the first bit body 602 and the second bit body 604 to protect flexible joint 606 and the actuators, e.g. actuators

608*a* or 608*b*. A flexible sleeve can be constructed from a variety of wear-resistant materials including rubber, poly-aramid fabrics, and the like.

In some embodiments, one or more sensors (e.g., vibration sensors, accelerometers, and the like) are positioned within drill bit 600 (e.g., within the first bit body 602 and/or the second bit body 604). Sensors can detect vibrations and other forces generated during drilling and dynamically dampen and/or counteract such disturbances by selectively deploying actuators, thereby preventing or minimizing propagation of the forces throughout the drill string.

Method of Drilling a Curved Borehole

Figure 7:
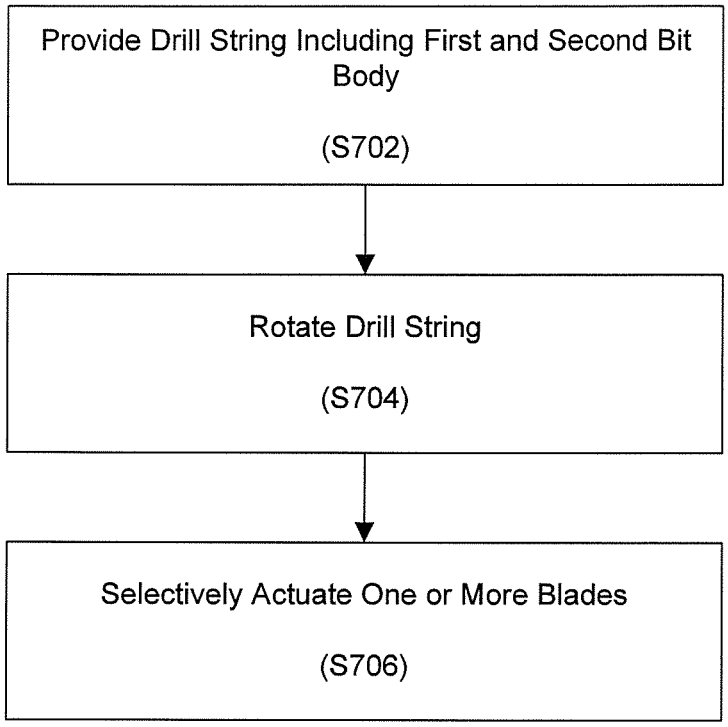
FIG. 7 depicts a method of drilling a curved borehole according to one embodiment of the invention.

Referring now to FIG. 7, a method of drilling a curved borehole is depicted. In step S702, a drill string is provided including a drill bit having a first bit body and a second bit body, a flexible joint, and one or more actuators. Suitable drill bits are described herein. In step S704, the drill string is rotated. In step S706, one or more of the actuators is selectively actuated to modulate the angle between the axis of rotation of the first bit body and the axis of rotation of the second bit body.

INCORPORATION BY REFERENCE

All patents, published patent applications, and other references disclosed herein are hereby expressly incorporated by reference in their entireties by reference.

EQUIVALENTS

Those skilled in the art will recognize, or be able to ascertain using no more than routine experimentation, many equivalents of the specific embodiments of the invention described herein. Such equivalents are intended to be encompassed by the following claims.

The invention claimed is:

1. A drill bit comprising:
a first bit body having:
an axis of rotation; and
a plurality of exterior cutters;
a second bit body having:
an axis of rotation; and
a plurality of exterior cutters;
a flexible joint connecting the first bit body and the second bit body; and
actuators configured to modulate an angle between the axis of rotation of the first bit body and the axis of rotation of the second bit body, the actuators being coupled linearly between the first bit body and the second bit body to enable regions of the first bit body and the second bit body to be linearly pushed apart or pulled together.

2. The drill bit of claim 1, further comprising:
a flexible sleeve positioned between the first bit body and the second bit body.

3. The drill bit of claim 1, wherein the actuators are compression actuators.

4. The drill bit of claim 1, wherein the actuators are tension actuators.

5. The drill bit of claim 1, further comprising:
a controller in communication with the actuators.

6. The drill bit of claim 1, wherein the actuators are each actuated sinusoidally with a frequency substantially equal to a rotational frequency of the drill bit.

7. The drill bit of claim 1, wherein the actuators include sensors.

8. A method for drilling a curved borehole, the method comprising:
providing a drill string including a drill bit including:
a first bit body having:
an axis of rotation; and
a plurality of exterior cutters;
a second bit body having:
an axis of rotation; and
a plurality of exterior cutters;
a flexible joint connecting the first bit body and the second bit body; and
one or more actuators configured to modulate an angle between the axis of rotation of the first bit body and the axis of rotation of the second bit body;
rotating the drill string; and
selectively actuating the one or more actuators to modulate the angle between the axis of rotation of the first bit body and the axis of rotation of the second bit body by applying a linear push or pull between regions of the first bit body and regions of the second bit body;
thereby drilling a curved borehole.

* * * * *

UNITED STATES PATENT AND TRADEMARK OFFICE

CERTIFICATE OF CORRECTION

PATENT NO. : 8,469,117 B2
APPLICATION NO. : 13/564705
DATED : June 25, 2013
INVENTOR(S) : Demosthenis Georgiou Pafitis et al.

It is certified that error appears in the above-identified patent and that said Letters Patent is hereby corrected as shown below:

On the Title Page, insert

--Related U.S. Application Data

(60) Division of application No. 12/556111, filed on Sep. 9, 2009, now Pat. No. 8307914.--

Signed and Sealed this
Thirty-first Day of March, 2015

Michelle K. Lee

Michelle K. Lee
*Director of the United States Patent and Trademark Office*